United States Patent [19]

Muramatsu

[11] 4,268,160

[45] May 19, 1981

[54] ELECTROPHOTOGRAPHIC COPYING APPARATUS CAPABLE OF REPRODUCING ELECTRIC SIGNAL IMAGE

[75] Inventor: Toshio Muramatsu, Hino, Japan

[73] Assignee: Konishiroku Photo Industry Co., Ltd., Tokyo, Japan

[21] Appl. No.: 62,961

[22] Filed: Aug. 2, 1979

[30] Foreign Application Priority Data

Aug. 4, 1978 [JP] Japan ..... 53-94645

[51] Int. Cl.[3] ..... G03G 15/00

[52] U.S. Cl. ..... 355/3 R; 346/153.1; 358/300

[58] Field of Search ..... 355/3 R, 3 TR, 3 TE; 346/153, 155, 157, 160; 358/300; 101/DIG. 13

[56] References Cited

U.S. PATENT DOCUMENTS 3,619,049 11/1971 Starkweather et al. ..... 355/3 R 4,124,286 11/1978 Barasch ..... 355/14 R 4,144,808 3/1979 Iwasa et al. ..... 355/3 R

*Primary Examiner*—Richard L. Moses

*Attorney, Agent, or Firm*—Bierman & Bierman

[57] ABSTRACT

An electrophotographic copying apparatus having a photosensitive medium for normal copying operations further includes an electric charge carrying medium for receiving and storing an electrostatic latent image in accordance with external electric signals, as from facsimile transmission. The charge carrying medium is moveable between a first position spaced from the photosensitive medium and a second position in image transferable relationship with the photosensitive medium. Latent image formation on the charge carrying medium is effected at the first position thereof so as to free the photosensitive member for concurrent normal electrophotographic copying operations.

6 Claims, 5 Drawing Figures

ELECTROPHOTOGRAPHIC COPYING APPARATUS CAPABLE OF REPRODUCING ELECTRIC SIGNAL IMAGE

BACKGROUND OF THE INVENTION

1. Field of the Invention

The present invention relates to an electrophotographic copying apparatus which is capable of reproducing an image represented by an electric signal. More particularly, the invention concerns a copying machine which incorporates a function of reproducing electric signal information available in facsimile or like equipment as a visible image in addition to the normal copying function of a conventional electrophotographic copying machine.

2. Description of the Prior Art

Both electrophotographic copying apparatus and facsimile equipment tend to be increasingly and widely employed for the purpose of enhancing efficiency in the communication of information in the business world. In this connection, it is however noted that facsimile equipment, which is usually more expensive than electrophotographic copying apparatus is in practice used at less frequency than the latter, which provides a great obstacle to expansion of use of the facsimile. Besides, hitherto known facsimile equipment suffers from various drawbacks. That is, the reproduced image is of a remarkably degraded quality despite the necessity to use a recording paper which has undergone specific treatments in the case of facsimile equipment of an electric discharge recording type. In addition, a high recording speed can not been attained, and an unpleasant smell is produced. Facsimile equipment of the thermal recording type is also disadvantageous in that a specific recording paper is required, the recording speed is low, and so forth. Although the electrostatic recording type equipment utilizing a discharge effect except for the discharge breakdown can enjoy a higher recording speed and an improved image quality as compared with the first and second mentioned equipment, there are disadvantage in that a specific recording paper is still required to be used and the equipment is quite expensive.

Under the circumstances, it is desirable to adopt, if possible, the electrophotographic copying system which allows the image reproducing treatments to be carried out rapidly in a facilitated manner with a greatly simplified structure. However, in consideration of the fact that a lot of time is required for receiving and processing the facsimile, the electrophotographic copying principle can not be straightforwardly applied to facsimile equipment, because there is an incompatibility in speeds between the electrophotographic copying operation and the facsimile signal receiving and processing operation. The former operation can be effected at a high speed, while the latter operation is attainable only at a relatively low speed.

As an attempt to eliminate the drawbacks of facsimile equipment such as low frequency of use, need for the specifically treated recording paper and so forth, it is conceivable to produce an image on a cathode ray tube CRT from the facsimile signal and then to project the CRT screen image onto a photosensitive medium of an electrophotographic copying apparatus in a similar manner as the image of an original to be copied is projected, thereby to visualize and record the electrical signals incoming from the facsimile equipment. This approach is advantageous over the hitherto known facsimile systems in that the screen image on the CRT can be electrophotographically copied. However, the main problem in that the visualising or copying treatment is inhibited during the reception of the facsimile signal which takes a lot of time-remains to be solved.

The above problem may be solved by storing the facsimile signals in an electric memory device and reconstructing the image on the basis of the information stored in the memory. However, this approach in turn requires a memory of a large capacity, involving ultimately high expenditure for the whole system.

BRIEF SUMMARY OF THE INVENTION

An object of the present invention is to provide an electrophotographic copying apparatus which is capable of reproducing an image represented by an electric signal and which is immune to the drawbacks and problems described above. The apparatus according to the invention is characterized in that images represented by electric signals such as facsimile signals are reproduced and recorded on common paper sheets (plain paper) by utilizing the treating processes of the conventional electrophotographic copying apparatus such as the charging, exposing, developing, transferring, fixing and cleaning processes, except for the exposure process.

In the following, the invention will be described in detail by referring to the accompanying drawings which show exemplary embodiments of the electrophotographic copying apparatus according to the present invention.

DETAILED DESCRIPTION OF THE PREFERRED EMBODIMENTS

Figure 1:
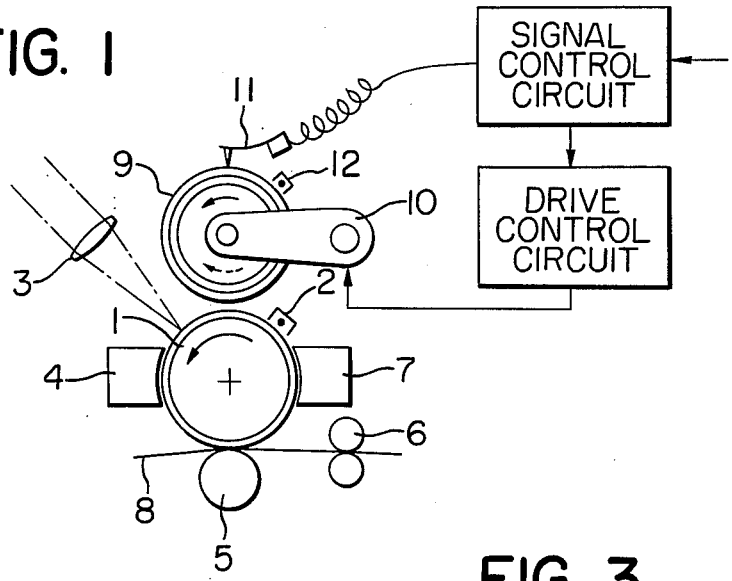
FIG. 1 is a side elevational view showing schematically an arrangement of a copying apparatus according to an embodiment of the invention.

Referring to FIG. 1, numeral 1 denotes a drum having a peripheral surface provided with a photosensitive medium or layer, such as selenium, cadmium sulfide or the like, and adapted to be rotated in the direction indicated by an attached arrow, the drum 1 being connected to a driving means (not shown) which supplies drive torque to the drum. 2 designates a device for imparting a uniform electric charge over the photosensitive surface of the drum 1 (referred to as a charging means hereinafter), 3 denotes a lens disposed in an image exposure optical system, 4 denotes a developing device for producing a toner image from an electrostatic latent image which has been produced on the photosensitive drum surface, 5 denotes an image transfer device for transferring the toner image to a copying sheet, 7 denotes a cleaning device for removing toner particles remaining on the drum after the transfer process, and finally numeral 8 denotes the transfer sheet. The components described so far cooperate with one another to perform a series of copying functions in a manner well known in the conventional electrophotographic copying apparatus. Numeral 9 designates an electric charge carrying medium (referred to as the electric charge carrying drum) which constitutes a part of an apparatus for reproducing visible images from electric signals available from an external electric signals information source such as facsimile equipment, for example. The electric charge carrying drum 9 is rotatably supported by swingable levers 10 so that the drum 9 may be moved toward and away from the photosensitive drum 1 by means of an appropriate driving mechanism. Numeral 11 designates schematically an electric charge imparting means which includes a needle-like discharge electrode for producing an electrostatic latent image on the peripheral surface of the electric charge carrying drum 9. It should be mentioned that the position of the needle-like discharge electrode is previously so determined that the discharge electrode is positioned in physical contact with or with a proper gap relative to the peripheral surface of the charge carrying drum 9 when the latter is at the position moved away from the photosensitive drum 1. Furthermore, the needle-like discharge electrode is moved to scan the drum surface in the generatrix direction thereof in synchronism with the rotation of the drum 9 in the direction indicated by an attached solid line arrow thereby to produce an electric charge pattern on the surface of the charge carrying drum 9 under the control of a signal control circuit. Numeral 12 denotes a charge removing electrode array.

When the electrophotographic copying apparatus shown in FIG. 1 is to be operated in a facsimile receiving mode, the charge carrying drum 9 is at first moved away from the photosensitive drum 1 through the levers 10, while the charge imparting means 11 constituted by the needle-like discharge electrode and the charge removing electrode array 12 are positioned close to the peripheral surface of the charge carrying drum 9. Upon initiation of the receiving operation of the electrical signals, the signal control circuit or electric signal generating means will supply to the charge imparting means 11 electric signals representative of a pattern image which signals are usually in a voltage range of 0 volts to 1000 volts. It goes without saying that an electrostatic latent image can not be obtained when 0 volts is applied to the charge imparting means. At the same time, the signal control circuit causes the charge imparting means 11 to be moved at a predetermined speed in the generatrix direction of the charge carrying drum 9, which is simultaneously rotated about the center axis thereof in correspondence to the original read-out operation of counterpart facsimile equipment operating in the transmitting mode. As a result, there is formed an electrostatic latent image of electric charges on the peripheral surface of the charge carrying drum 9 which is scanned by the needle-like discharge electrode along a spiral path after the charge previously stored on the drum surface has been removed by the electrode array 12. In conjunction with this, it is to be noted that the rotating direction of the charge carrying drum 9 is not restricted to the one indicated by the solid-line arrow. The scanning speed of the charge imparting means 11 relative to the revolution number of the charge carrying drum is determined so as to conform to the type of the original reading operation adopted in the facsimile transmitter, as described hereinbefore. However, it should be mentioned that when the charge imparting means 11 of the type in which a plurality of needle-like discharge electrodes connecting to corresponding terminals (not shown) provided in the signal receiving equipment are arrayed in a row along a generatrix of the charge carrying drum is employed, the movement along the axial direction of the charging means 11 becomes unnecessary, while the charge carrying drum 9 may be rotated at a relatively low speed to produce one frame of latent image during a single revolution of the charge carrying drum 9.

By virtue of the arrangement such that the charge carrying drum 9 is physically spaced from the peripheral surface of the photosensitive drum 1 in the operative mode as the facsimile receiver, it is possible to carry out a normal electrophotographic copying operation concurrently with the facsimile receiving operation described above.

Figure 2:
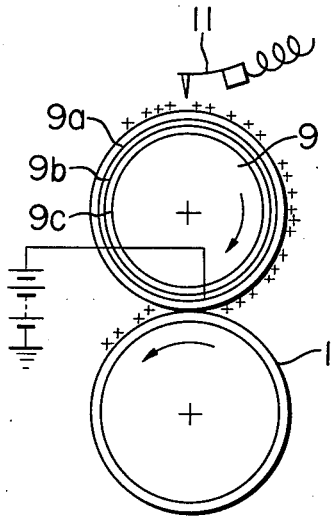
FIGS. 2 and 3 illustrate schematically constructions and operations of a charge carrying medium constituting a part of an apparatus for producing an electrostatic latent image in dependence on information signal input.
Figure 3:
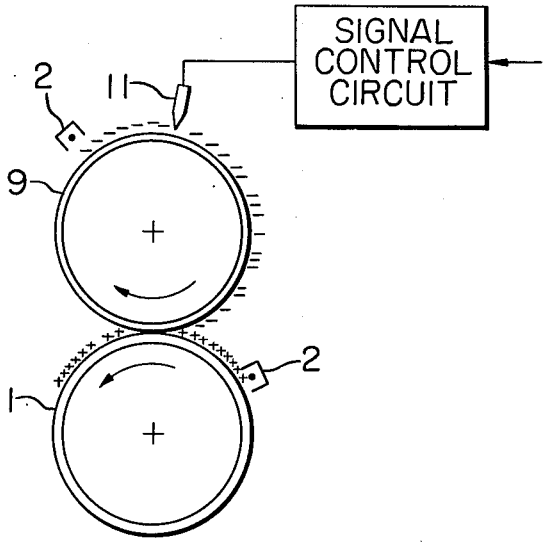

When a frame of an electrostatic latent image which may extend over substantially the whole peripheral surface of the charge carrying drum 9 at maximum has been formed at the end of the facsimile receiving operation, the charge carrying drum 9 is then moved toward the photosensitive drum 1 and rotated in the same direction at a point of contact or nearest point formed therebetween as indicated by the broken line arrow at a speed equal to that of the photosensitive drum, which speed is normally adopted in the electrophotographic copying operation, thereby to cause transfer of the electrostatic latent image formed on the charge carrying drum 9 to the photosensitive peripheral surface of the copying drum 1. In this case, any electric charge on the peripheral surface of the photosensitive drum 1 must to be previously removed by making inoperative the charge imparting means 2 provided in association with the photosensitive drum 1. Subsequently, the electrostatic latent image transferred onto the photosensitive drum 1 from the charge carrying drum 9 can be developed into a corresponding toner image by the developing device 7 and transferred to the copying sheet 8 in a manner similar to that of the normal electrophotographic copying operation. In conjunction with this, it is to be noted that the peripheral surface of the charge carrying drum 9 should preferably be placed at a position spaced from the surface of the photosensitive drum by a distance of several microns in order to attain latent image transfer without involving any loss in image quality, as in contrast and sharpness. However, the drums 1 and 9 may be brought into surface contact with each other. When a space of several microns is to be maintained between the drums 1 and 9 which must be rotated at the same peripheral speed as described above, there may arise difficulty in that these drums must be fabricated with a minimum eccentricity and a complicated speed control procedure must be adopted. With a view to avoiding such difficulty, a charge storing layer **9*a* of the charge carrying drum 9 which is formed of a dielectric material such as polyester, polyamide, polyurethane, acryl resins or the like may be finished in a rough surface or alternatively roughened by dispersing particles (preferably of an electrically insulating material) in the charge storing layer 9*a* in a partially exposed state, as is illustrated in FIG. 2. With such structure of the charge storing surface layer 9*a*, the charge carrying drum 9 may be positioned in surface contact with the photosensitive drum 1 with the similar advantage being attained as in the case where the charge carrying drum is spaced by an extremely small distance of several microns from the photosensitive drum 1, because close or intimate contact between the drums 9 and 1 is prevented by the roughened surface of the drum 9. In this connection, it is noted that the electric charge carrying medium is referred to herein as being positioned extremely small distance from the surface of the photosensitive medium, although the mediums are actually in contact with each other. Moreover, the same surface speed can be attained for both the drums 9 and 1 simply, for example, through the frictional contact. As can be seen from FIG. 2, the charge carrying drum 9 further comprises an electrically insulating layer 9***c* arranged at the inner surface of the charge storing layer 9*a*, wherein a bias voltage of the same polarity as that of the charge to be stored in the outermost layer 9*a* is applied to the electrically conductive layer 9*b*. With such arrangement, the transfer of the electrostatic latent image from the charge carrying drum 9 to the photosensitive drum 1 can be much facilitated. When the insulating layer 9*c* is formed of a resilient material such as rubber, the shock which would be applied to the photosensitive drum 1 when the charge carrying drum 1 is brought into contact therewith can be damped by the buffer layer 9*c*. Furthermore, variations in gap size between the surface of the drums 1 and 9 due to eccentricities thereof can be absorbed by the resilient insulation layer 9*c*, whereby the drums 1 and 9 can be maintained in the partial surface contacting state with a gap determined by the roughness or particulate protrusions of the outermost layer 9*a*, while the overall contact area can be advantageously increased to assure the same peripheral speed for both drums 1 and 9. In the case of the illustrated embodiement shown in FIG. 2, it is assumed that the electrostatic latent image is formed on the peripheral surface of the charge carrying drum by an electric charge of positive polarity and is then transferred to the surface of the photosensitive drum 1 from which any residual charge has previously been completely removed. However, it will be appreciated that an electric charge of negative polarity may of course be used for forming the electrostatic latent image on the drum 9 in consideration of the electrostatic characteristics of the developing toner used. FIG. 3 illustrates a typical case where the facsimile recording is carried out with the peripheral surface of the photosensitive drum being uniformly charged as in the electrophotographic copying operation. In this case, an advantage is attained that the complete removal of electric charge from the photosensitive drum is unnecessary before the peripheral surface of the photosensitive drum 1 is charged uniformly. In this case, there are two ways for forming the electrostatic latent image on the charge carrying drum 9 in accordance with the facsimile signal. According to the first process, an electrostatic latent image of a polarity opposite to that of the charge uniformly imparted to the peripheral surface of the photosensitive drum 1 is formed on the peripheral surface of the charge carrying drum 9 from which any residual charge has been previously removed, thereby to prepare a positive latent image in a manner similar to that illustrated in FIG. 1. Another process resides in that the peripheral surface of the charge carrying drum 9 is electrically charged uniformly with the polarity opposite to that of the charge imparted uniformly to the outer surface of the photosensitive drum 1, whereby the charge on the charge carrying drum 9 is removed in accordance with the facsimile signal thereby to prepare a negative latent image. In any case, the charge carrying drum 9 is brought into contact with the photosensitive drum 1 in the manner described hereinbefore, whereupon the electric charge on the charge carrying drum 9 is neutralized by the charge on the photosensitive drum. Thus, according to the first process, a negative latent image is produced on the photosensitive drum 1 by the residual charge after the neutralization, while according to the second process, a positive latent image is produced by the residual charge after the neutralization. In this connection, it will be noted that the second process is advantageous over the first method in that the residual charge on the charge carrying drum 9 need not be perfectly removed before the uniform charging thereof.

Figure 4:
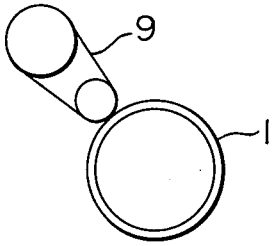
FIG. 4 is a schematic side elevational view showing a structure of the charge carrying medium according to another embodiment of the invention.

The processes for forming the electrostatic latent image on the charge carrying drum as well as processes for transferring the latent image to the photosensitive drum are selected in proper combinations in consideration of the electrostatic characteristics of the developing toners to be used. The charge carrying drum 9 may be replaced by a belt-like member suspended on rotating rollers as illustrated in FIG. 4. The belt-like charge carrying member can advantageously be implemented in a long length, thereby to allow an electrostatic latent image of increased size to be produced in correspondence with an increased quantity of received information. Furthermore, the belt-like charge carrying medium can be advantageously installed even in a relatively restricted space adjacent to the photosensitive drum.

Figure 5:
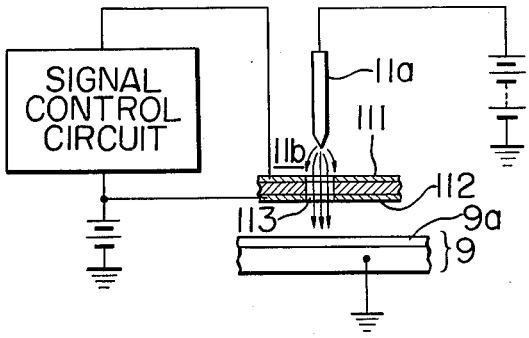
FIG. 5 shows schematically an arrangement of a charge imparting device for producing an electrostatic latent image on the charge carrying medium according to another embodiment of the invention.

The charge imparting means 11 for electrically charging the charge carrying medium 9 such as the drum and the belt in dependence upon the electric signal input may be implemented in a structure such as shown in FIG. 5. In this figure, reference symbol 11*a* denotes a discharge electrode applied with a high D.C. voltage, and 11*b* denotes a control electrode plate having electrodes 111 and 112 disposed at the upper and lower sides of an insulating member, respectively. An aperture 113 is formed in the control electrode assembly 11*b* for allowing an ion beam produced from the discharge electrode 11*a* to pass therethrough. The signal voltage produced by the signal control unit in dependence upon the image or pattern information as received is applied across the electrodes 111 and 112 of the control electrode plate 11*b* to vary the intensity of the ion beam passing through the aperture 113, thereby to produce a corresponding electrostatic latent image on the charge storing layer 9*a* of the charge carrying medium 9. Because the charge imparting means described above is operative to form the electrostatic latent image on the charge carrying medium 9 in a contactless manner, the surface of the charge carrying medium 9 will never undergo frictional abrasion.

In the foregoing description, it has been assumed that the invention is applied to record facsimile information. However, it should be appreciated that the invention is not restricted to such application but can be equally embodied in combination with any device capable of producing electrostatic latent images from electric signals.

The present invention provides an electrophotographic copying apparatus which is capable of reproducing a clear image on conventional or usual paper sheets from electric signals representing the image to be reproduced and additionally performing the inherent copying operations while the electric signal is simultaneously received and converted into a corresponding electrostatic latent image, thus assuring high efficiency as well as enhanced reliability in operation with a simplified and inexpensive structure.

What is claimed is:

1. In an electrophotographic copying apparatus for normally producing a copy of an original and including a photosensitive medium rotatable at a predetermined speed, means for projecting onto the photosensitive medium an image of an original to be copied to produce an electrostatic latent image thereof on the medium, means for developing the latent image on the medium, and means for moving a copy sheet into transferable relation with the medium so as to transfer the developed image of the original onto the copy sheet; secondary means for receiving an image represented by an electric signal concurrently and without interfering with normal electrophotographic copying operations of the apparatus and at a rate independent of the operative speed of the normal copying operation, said secondary means comprising:

an electric charge carrying medium movable between a first position spaced from the surface of the photosensitive medium and a second position in transferable relationship with the surface of the medium;

an electric signal generating means;

means for producing an electrostatic latent image on the charge carrying medium in said first position thereof in accordance with electric signals of the electric signal generating means and at a rate independent of the predetermined rotative speed of the photosensitive medium, the formation of said latent image on the charge carrying medium at said first position thereof enabling concurrent, independent use of the photosensitive medium for electrostatic; and means for selectively moving said charge carrying medium from said first to said second position and for driving said charge carrying medium in the same direction as and at the predetermined rotative speed of the photosensitive medium during times when the photosensitive medium is not involved in normal electrophotographic copying operations so as to transfer an electrostatic latent image on said charge carrying medium onto the photosensitive medium for subsequent development and transfer to a copy sheet;

whereby the movability of said electric charge carrying medium from said second position in transferable relation with the photosensitive medium to said first position spaced therefrom permits the receipt and storage on the charge carrying medium of an electrostatic latent image from a secondary source while the photosensitive medium is concurrently utilized in normal electrophotographic copying operations such that transfer of the stored image to the photosensitive medium for subsequent development and transfer to a copy sheet can be effected at a selectable time when the photosensitive medium is not involved in electrophotographic copying.

2. In an electrophotographic copying apparatus according to claim 1, said electric charge carrying medium having a matte surface formed of a dielectric material.

3. In an electrophotographic copying apparatus according to claim 2, said transferable relationship of said second position comprising contact of the matte surface of the electric charge carrying medium with the surface of the photosensitive medium.

4. In an electrophotographic copying apparatus according to claim 3, means for imparting an electric charge of a first polarity uniformly over the surface of the charge carrying medium, and means for imparting an electric charge of a second polarity opposite said first polarity uniformly over the surface of the photosensitive medium, said means for producing a latent image on the charge carrying medium producing said latent image by erasing said uniform electric charge of said first polarity in accordance with the electric signals of the signal generating means whereby the latent image is transferred from said charge carrying means to the photosensitive means as a latent image of said second polarity through said contact between the charge carrying medium and the photosensitive medium.

5. In an electrophotographic copying apparatus according to claim 4, a bias voltage applying device for applying an electric charge to said charge carrying medium for facilitating transfer of the electrostatic latent image from the charge carrying medium to the photosensitive medium in said second position of the charge carrying medium.

6. In an electrophotographic copying apparatus according to claim 1, said transferable relationship of said second position of the charge carrying medium comprising a spacing between the charge carrying medium and the photosensitive medium of several microns.

* * * * *